US010844326B2

(12) United States Patent
Tuerk et al.

(10) Patent No.: US 10,844,326 B2
(45) **Date of Patent: *Nov. 24, 2020**

(54) FORMULATIONS AND PRODUCTION AND USE THEREOF

(71) Applicant: BASF SE, Ludwigshafen am Rhein (DE)

(72) Inventors: Holger Tuerk, Ludwigshafen (DE); Heike Weber, Ludwigshafen (DE); Ditmar Kischkel, Düsseldorf-Holthausen (DE); Juergen Franke, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 0 days.

This patent is subject to a terminal disclaimer.

(21) Appl. No.: 16/461,881

(22) PCT Filed: Nov. 8, 2017

(86) PCT No.: PCT/EP2017/078568

§ 371 (c)(1),
(2) Date: May 17, 2019

(87) PCT Pub. No.: WO2018/091326

PCT Pub. Date: May 24, 2018

(65) Prior Publication Data

US 2019/0367842 A1 Dec. 5, 2019

(30) Foreign Application Priority Data

Nov. 17, 2016 (EP) ..... 16199255

(51) Int. Cl.

| | |
|---|---|
| ***C11D 1/66*** | (2006.01) |
| ***C11D 1/72*** | (2006.01) |
| ***C11D 3/33*** | (2006.01) |
| ***C11D 3/37*** | (2006.01) |
| ***C11D 11/00*** | (2006.01) |
| ***C11D 1/722*** | (2006.01) |
| ***C11D 3/20*** | (2006.01) |
| ***C11D 3/30*** | (2006.01) |

(52) U.S. Cl.

CPC ..... *C11D 3/3788* (2013.01); *C11D 1/722* (2013.01); *C11D 3/2086* (2013.01); *C11D 3/30* (2013.01); *C11D 3/33* (2013.01); *C11D 11/0029* (2013.01); *C11D 11/0035* (2013.01)

(58) Field of Classification Search

CPC .. C11D 1/66; C11D 1/662; C11D 1/72; C11D 3/042; C11D 3/33; C11D 3/37; C11D 3/3788; C11D 11/00

See application file for complete search history.

(56) References Cited

U.S. PATENT DOCUMENTS

| | | | | |
|---|---|---|---|---|
| 10,294,444 | B2 | 5/2019 | Türk et al. | |
| 2011/0118168 | A1* | 5/2011 | Schunicht | C08F 251/00 510/400 |
| 2017/0130168 | A1* | 5/2017 | Turk | C11D 3/3788 |
| 2017/0145352 | A1 | 5/2017 | Türk et al. | |

FOREIGN PATENT DOCUMENTS

| | | | | |
|---|---|---|---|---|
| DE | 4316743 | A1 | 11/1994 | |
| DE | 19819187 | A1 | 11/1999 | |
| EP | 0851023 | A2 | 7/1998 | |
| EP | 2138560 | A1 | 12/2009 | |
| WO | 2015197379 | A1 | 12/2015 | |
| WO | WO 2015/197379 | * | 12/2015 | C07C 227/18 |
| WO | 2017186524 | A1 | 11/2017 | |

OTHER PUBLICATIONS

European Search Report for EP Patent Application No. 16199255.7, dated May 23, 2017, 3 pages.
International Search Report for International Application No. PCT/EP2017/078568, dated Jan. 24, 2018, 3 pages.

* cited by examiner

*Primary Examiner* — Brian P Mruk
(74) *Attorney, Agent, or Firm* — Armstrong Teasdale LLP

(57) ABSTRACT

Described herein is a formulation including
(A) at least one nonionic surfactant,
(B) at least one graft copolymer formed from
(a) at least one graft base selected from nonionic monosaccharides, disaccharides, oligosaccharides and polysaccharides, and side chains; and
(C) a total of zero to 0.5% by weight of methylglycinediacetic acid (MGDA) and glutaminediacetic acid (GLDA) and alkali metal salts of MGDA and GLDA and a total of zero to 0.5% by weight of citric acid or an alkali metal salt of citric acid, where figures in % by weight are based in each case on a solids content of the formulation in question.

15 Claims, No Drawings

FORMULATIONS AND PRODUCTION AND USE THEREOF

CROSS-REFERENCE TO RELATED APPLICATIONS

This application is a U.S. National Phase Application of PCT/EP2017/078568, filed Nov. 8, 2017, which claims the benefit of priority to European Patent Application No. 16199255.7, filed Nov. 17, 2016, the entire contents of which are hereby incorporated by reference herein.

FIELD OF INVENTION

The present application relates to formulations comprising (A) at least one nonionic surfactant, (B) at least one graft copolymer formed from (a) at least one graft base selected from nonionic monosaccharides, disaccharides, oligosaccharides and polysaccharides, and side chains, obtainable by grafting of (b) at least one ethylenically unsaturated mono- or dicarboxylic acid and (c) at least one compound of the general formula (I)

(I)

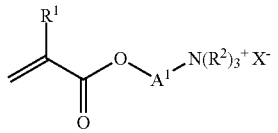

where the variables are defined as follows:

$R^1$ is selected from methyl and hydrogen, $A^1$ is selected from $C_2$-$C_4$-alkylene, $R^2$ are the same or different and are selected from $C_1$-$C_4$-alkyl, $X^-$ is selected from halide, mono-$C_1$-$C_4$-alkylsulfate and sulfate, (C) a total of zero to 0.5% by weight of methylglycinediacetic acid (MGDA) and glutaminediacetic acid (GLDA) and alkali metal salts of MGDA and GLDA, and a total of zero to 0.5% by weight of citric acid and alkali metal salt of citric acid.

Cleaning compositions for hard surfaces, for example all-purpose kitchen cleaners and all-purpose bathroom cleaners, but also dishwasher detergents, manual dishwashing detergents, glass cleaners, kitchen cleaners, bathroom and sanitary cleaners, toilet cleaners and disinfection cleaners, frequently comprise ingredients that lead to hydrophilization of hard surfaces, the effect of which is that water spreads better on such hard surfaces and water droplets more quickly form a film that can then run off more easily.

BACKGROUND

EP 2 138 560 A1 discloses graft copolymers and the use thereof in compositions for cleaning of hard surfaces, including as dishwashing detergents. However, the cleaning compositions disclosed in EP 2 138 560 A1 still have a certain degree of "filming" or "spotting", in particular on glass, ceramic and stainless steel, which is not an optimal result from the end user's point of view.

WO 2015/197379 discloses formulations comprising a graft copolymer and additionally a builder selected from MGDA and GLDA and salts thereof. The formulations disclosed do exhibit good inhibition of scale—especially in phosphate-free dishwashing detergents and especially on glass. However, the formulations still have potential for improvement for use as all-purpose cleaner and as rinse aid for dishware.

DESCRIPTION

There was thus a need to provide formulations which, particularly on glass, ceramic and stainless steel surfaces, can contribute to distinctly higher hydrophilization, which is associated with improved wetting, and hence to improved retention of shine and if at all possible also to improved cleaning performance.

A further problem addressed was that of providing a process by which formulations of this kind can be produced.

Accordingly, the formulations defined at the outset have been found, and these are also referred to in the context of the present invention as formulations of the invention.

Formulations of the invention may be in solid, liquid, paste or gel form at room temperature, i.e. at 20° C. Preferably, formulations of the invention are liquid at room temperature. Formulations of the invention that are solid at room temperature may be anhydrous or comprise water, for example up to 20% by weight, preferably 0.1% to 10% by weight of water, determinable, for example, by Karl Fischer titration or by determination of the dry residue at 80° C. under reduced pressure. Formulations of the invention that are solid at room temperature may take the form, for example, of powder, granules or tablets.

In another embodiment, formulations of the invention are liquid at 20° C. Formulations of the invention that are liquid at 20° C. may comprise 10% to 99.5% by weight of water, preferably 40% to 99% by weight, more preferably 80 to 99% by weight. In such embodiments too, the water content can be determined by determining the dry residue at 80° C. under reduced pressure. Formulations of the invention that are liquid at room temperature may, for example, be in gel form, or of a solution, suspension or emulsion.

Formulations of the invention comprise (A) at least one nonionic surfactant, also referred to in the context of the present invention as compound (A) for short, surfactant (A) or nonionic surfactant (A).

Preferred nonionic surfactants (A) are alkoxylated alcohols and alkoxylated fatty alcohols, di- and multiblock copolymers of ethylene oxide and propylene oxide and reaction products of sorbitan with ethylene oxide or propylene oxide, alkyl polyglycosides and what are called amine oxides.

Preferred examples of alkoxylated alcohols and alkoxylated fatty alcohols are compounds of the general formula (II)

(II)

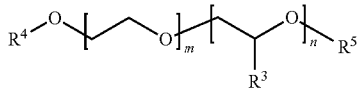

in which the variables are defined as follows:

$R^3$ are the same or different and are selected from linear $C_1$-$C_{10}$-alkyl, preferably ethyl and more preferably methyl, $R^4$ is selected from $C_8$-$C_{22}$-alkyl, for example n-$C_8H_{17}$, n-$C_{10}H_{21}$, n-$C_{12}H_{25}$, n-$C_{14}H_{29}$, n-$C_{16}H_{33}$ or n-$C_{18}H_{37}$, or mixtures of two or more of the alkyl radicals above, $R^5$ is selected from hydrogen and $C_1$-$C_{10}$-alkyl, methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl or isodecyl, m and n are in the range from zero to 300, where the sum of n and m is at least one. Preferably, m is in the range from 1 to 100 and n is in the range from 0 to 30.

Compounds of the general formula (II) may be block copolymers or random copolymers, preferably block copolymers.

Other preferred examples of alkoxylated alcohols and alkoxylated fatty alcohols are compounds of the general formula (III)

(III)

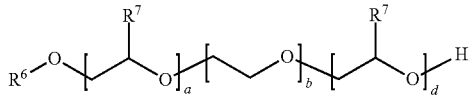

in which the variables are defined as follows:

$R^6$ is selected from $C_6$-$C_{20}$-alkyl, especially n-$C_8H_{17}$, n-$C_{10}H_{21}$, n-$C_{12}H_{25}$, n-$C_{14}H_{29}$, n-$C_{16}H_{33}$, n-$C_{18}H_{37}$, $R^7$ are the same or different and are selected from linear $C_1$-$C_4$-alkyl, and are preferably each the same and are ethyl and more preferably methyl.

a is a number in the range from 1 to 6, b is a number in the range from 4 to 205.

d is a number in the range from 4 to 25.

Compounds of the general formula (III) may be block copolymers or random copolymers, preferably block copolymers.

Other preferred examples of alkoxylated alcohols and alkoxylated fatty alcohols are hydroxy mixed ethers of the general formula (IV)

$$R^8—CH(OH)—CH_2—O-(AO)_k—R^9 \quad (IV)$$

where the variables are selected as follows:

$R^8$ $C_4$-$C_{30}$-alkyl, branched or unbranched, or $C_4$-$C_{30}$-alkenyl, branched or unbranched, having at least one C—C double bond.

Preferably, $R^8$ is selected from $C_4$-$C_{30}$-alkyl, branched or unbranched, more preferably unbranched $C_4$-$C_{30}$-alkyl and most preferably n-$C_{10}$-$C_{12}$-alkyl.

$R^9$ $C_1$-$C_{30}$-alkyl, branched or unbranched, or $C_2$-$C_{30}$-alkenyl, branched or unbranched, having at least one C—C double bond.

Preferably, $R^9$ is selected from $C_4$-$C_{30}$-alkyl, branched or unbranched, more preferably unbranched $C_6$-$C_{20}$-alkyl and most preferably n-$C_8$-$C_{11}$-alkyl.

k is a number in the range from 1 to 100, preferably from 5 to 60, more preferably 10 to 50 and most preferably 15 to 40, AO is selected from alkylene oxide, different or the same, and selected from $CH_2$—$CH_2$—O, $(CH_2)_3$—O, $(CH_2)_4$—O, $CH_2CH(CH_3)$—O, $CH(CH_3)$—$CH_2$—O— and $CH_2CH(n\text{-}C_3H_7)$—O. A preferred example of AO is $CH_2$—$CH_2$—O (EO).

In one embodiment of the present invention, $(AO)_k$ is selected from $(CH_2CH_2O)_{k1}$ where k1 is selected from numbers in the range from 1 to 50.

In one embodiment of the present invention, $(AO)_k$ is selected from —$(CH_2CH_2O)_{k2}$—$(CH_2CH(CH_3)$—$O)_{k3}$ and —$(CH_2CH_2O)_{k2}$—$(CH(CH_3)CH_2$—$O)_{x3}$ where k2 and k3 may be the same or different and are selected from numbers in the range from 1 to 30.

In one embodiment of the present invention, $(AO)_k$ is selected from —$(CH_2CH_2O)_{k4}$ where k4 is in the range from 10 to 50, AO is EO, and $R^8$ and $R^9$ are selected independently from $C_8$-$C_{14}$-alkyl.

In the context of the present invention, k and k1, k2, k3 and k4 are each understood to mean averages, preferably the numerical average. Therefore, each of the variables k and k1, k2, k3 or k4—if present—can mean a fraction. A particular molecule may of course always bear just a whole number of AO units.

Further examples of suitable nonionic surfactants are compounds of the general formula (V) and especially of the formula (V a)

(V)

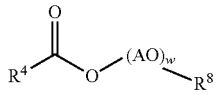

(Va)

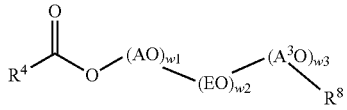

where $R^4$ and AO are as defined above and EO is ethylene oxide, i.e. $CH_2CH_2O$, where the AO in formula (VII) and (VII a) may each be the same or different, $R^8$ is selected from $C_8$-$C_{18}$-alkyl, linear or branched, $A^3O$ is selected from propylene oxide and butylene oxide, w is a number in the range from 15 to 70, preferably 30 to 50, w1 and w3 are numbers in the range from 1 to 5 and w2 is a number in the range from 13 to 35.

Examples of alkyl polyglycosides are especially compounds of the formula (VI)

(VI)

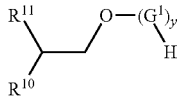

where $R^{10}$ is selected from $C_1$-$C_{10}$-alkyl, especially ethyl, n-propyl or isopropyl, or hydrogen $R^{11}$ is —$(CH_2)_2$—$R^{10}$ or $C_1$-$C_{10}$-alkyl $G^1$ is selected from monosaccharides having 4 to 6 carbon atoms, preferably glucose or xylose, y is in the range from 1.1 to 4, where y is an average value.

Further suitable nonionic surfactants are selected from di- and multiblock copolymers formed from ethylene oxide and propylene oxide. Further suitable nonionic surfactants are selected from ethoxylated or propoxylated sorbitan esters. Likewise suitable are amine oxides or alkyl glycosides. An overview of suitable further nonionic surfactants can be found in EP-A 0 851 023 and in DE-A 198 19 187.

It is also possible for mixtures of a plurality of various nonionic surfactants to be present.

In a preferred embodiment of the present invention, compound (A) is selected from alcohol alkoxylates and alkyl polyglycosides. Preference is given to alcohol alkoxylates.

Formulations of the invention comprise only a small amount of MGDA and salts thereof, if any. Formulations of the invention comprise only a small amount of GLDA and salts thereof, if any. Formulations of the invention comprise only a small amount of citric acid and salts thereof, if any. Specifically, formulations of the invention comprise (C) zero to a maximum of 0.5%, preferably zero to 0.1% by weight, of methylglycinediacetic acid (MGDA) and glutaminediacetic acid (GLDA) and alkali metal salts of MGDA and GLDA. It is unimportant in the context of the present invention whether MGDA or GLDA or the corresponding salts are in enantiomerically pure or racemic form or in the form of an enantiomerically enriched mixture.

Moreover, formulations of the invention comprise from zero to 0.5% by weight of citric acid and alkali metal salt of citric acid.

GLDA and MGDA and alkali metal salts thereof may be in the form of hydrates. Citric acid itself and salts of citric acid are generally in the form of hydrates. For example, sodium citrate under standard conditions is generally in dihydrate form, and potassium citrate in monohydrate form. Unless explicitly stated otherwise, in the context of the present invention, stated amounts in connection with compound (A) always relate to the active ingredient, i.e. do not take account of hydrate. Unless explicitly stated otherwise, in the context of the present invention, stated amounts in connection with MGDA or GLDA or citric acid or the alkali metal salts thereof always relate to the active ingredient, i.e. do not take account of hydrate.

Formulations of the invention comprise (B) at least one graft copolymer, which is also referred to in the context of the present invention as graft copolymer (B) or inventive graft copolymer (B), and is formed from
  (a) at least one graft base, called graft base (a) for short, selected from nonionic monosaccharides, disaccharides, oligosaccharides and polysaccharides, and side chains, obtainable by grafting of
  (b) at least one ethylenically unsaturated mono- or dicarboxylic acid, called monocarboxylic acid (b) or dicarboxylic acid (b) for short, and
  (c) at least one compound of the general formula (I), called monomer (c) or compound (c) or compound (I) for short, (I)

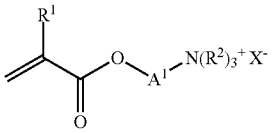

where the variables are defined as follows:

$R^1$ is selected from methyl and hydrogen, $A^1$ is selected from $C_2$-$C_4$-alkylene, $R^2$ are the same or different and are selected from $C_1$-$C_4$-alkyl, $X^-$ is selected from halide, mono-$C_1$-$C_4$-alkylsulfate and sulfate.

Nonionic monosaccharides suitable as graft base (a) that are selected may, for example, be aldopentoses, pentuloses (ketopentoses), aldohexoses and hexuloses (ketohexoses). Suitable aldopentoses are, for example, D-ribose, D-xylose and L-arabinose. Aldohexoses include D-glucose, D-mannose and D-galactose; examples of hexuloses (ketohexoses) particularly include D-fructose and D-sorbose.

In the context of the present invention, deoxy sugars, for example L-fucose and L-rhamnose, should also be counted among the nonionic monosaccharides.

Examples of nonionic disaccharides include, for example, cellobiose, lactose, maltose and sucrose.

Nonionic oligosaccharides in the context of the present invention shall refer to nonionic carbohydrates having three to ten nonionic monosaccharide units per molecule, for example glycans. Nonionic polysaccharides in the context of the present invention refer to nonionic carbohydrates having more than ten nonionic monosaccharide units per molecule. Nonionic oligo- and polysaccharides may, for example, be linear, branched or cyclic.

Examples of nonionic polysaccharides include biopolymers such as starch and glycogen, and cellulose and dextran. These further include inulin as a polycondensate of D-fructose (fructans) and chitin. Further examples of nonionic polysaccharides are nonionic starch degradation products, for example products which can be obtained by enzymatic or what is called chemical degradation of starch. One example of the chemical degradation of starch is acid-catalyzed hydrolysis.

Preferred examples of nonionic starch degradation products are maltodextrins. Maltodextrin in the context of the present invention covers mixtures of monomers, dimers, oligomers and polymers of glucose. The percentage composition differs according to the degree of hydrolysis. The percentage composition is defined in terms of the dextrose equivalent, which is between 3 and 40 in the case of maltodextrin.

Preferably, graft base (a) is selected from nonionic polysaccharides, especially from starch which has preferably not been chemically modified, for example wherein the hydroxyl groups have preferably been neither esterified nor etherified. In one embodiment of the present invention, starch is selected from those nonionic polysaccharides having in the range from 20% to 30% by weight of amylose and in the range from 70% to 80% amylopectin. Examples are corn starch, rice starch, potato starch and wheat starch.

Side chains have been grafted onto the graft base (a). For every molecule of graft copolymer (B), preferably an average of one to ten side chains can be grafted on. Preferably, one side chain is joined to the anomeric carbon atom of a monosaccharide or to an anomeric carbon atom of the chain end of an oligo- or polysaccharide. The upper limit in the number of side chains arises from the number of carbon atoms having hydroxyl groups in the graft base (a) in question.

Examples of monocarboxylic acids (b) are ethylenically unsaturated $C_3$-$C_{10}$-monocarboxylic acids and the alkali metal or ammonium salts thereof, especially the potassium and sodium salts. Preferred monocarboxylic acids (b) are acrylic acid and methacrylic acid, and also sodium (meth) acrylate. Mixtures of ethylenically unsaturated $C_3$-$C_{10}$ monocarboxylic acids and especially mixtures of acrylic acid and methacrylic acid are also preferred components (b).

Examples of dicarboxylic acids (b) are ethylenically unsaturated $C_4$-$C_{10}$-dicarboxylic acids and the mono- and especially dialkali metal or ammonium salts thereof, especially the dipotassium and disodium salts, and anhydrides of ethylenically unsaturated $C_4$-$C_{10}$-dicarboxylic acids.

Preferred dicarboxylic acids (b) are maleic acid, fumaric acid, itaconic acid, and also maleic anhydride and itaconic anhydride.

In one embodiment, graft copolymer (B) comprises, in at least one side chain, as well as monomer (c), at least one monocarboxylic acid (b) and at least one dicarboxylic acid (b). In a preferred embodiment of the present invention, graft copolymer (B) comprises, in the side chains, aside from monomer (c), exclusively copolymerized monocarboxylic acid (b) and no dicarboxylic acid (b).

Monomers (c) are ethylenically unsaturated N-containing compounds having a permanent cationic charge.

(I)

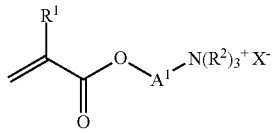

where the variables are defined as follows:

$R^1$ is selected from methyl and hydrogen, $A^1$ is selected from $C_2$-$C_4$-alkylene, for example —$CH_2$—$CH_2$—, $CH_2$—$CH(CH_3)$—, —$(CH_2)_3$—, —$(CH_2)_4$—, preference being given to —$CH_2$—$CH_2$— and —$(CH_2)_3$—, $R^2$ are different or preferably the same and are selected from $C_1$-$C_4$-alkyl, for example methyl, ethyl, n-propyl, n-butyl, isopropyl, isobutyl, sec-butyl, tert-butyl; preferably at least two $R^2$ are the same and are each methyl, and the third $R^2$ group is ethyl, n-propyl or n-butyl, or two $R^2$ are the same and are each ethyl, and the third $R^2$ group is methyl, n-propyl or n-butyl. More preferably, all three $R^2$ are each the same and are selected from methyl.

$X^-$ is selected from halide, for example bromide, iodide and especially chloride, and also from mono-$C_1$-$C_4$-alkylsulfate and sulfate. Examples of mono-$C_1$-$C_4$-alkylsulfate are methylsulfate, ethylsulfate, isopropylsulfate and n-butylsulfate, preferably methylsulfate and ethylsulfate. When $X^-$ is selected as sulfate, $X^-$ is half an equivalent of sulfate.

In a preferred embodiment of the present invention, the variables in monomer (c) are selected as follows:

$R^1$ is hydrogen or methyl, $R^2$ are the same and are each methyl, $A^1$ is $CH_2CH_2$, and $X^-$ is chloride.

In one embodiment of the present invention, monomer (c) is selected from

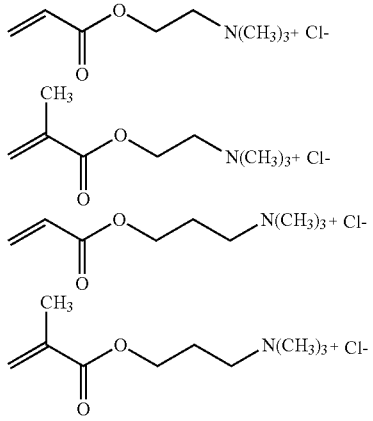

Graft copolymer (B) may comprise, in one or more side chains, at least one further copolymerized comonomer (d), for example hydroxyalkyl ester such as 2-hydroxyethyl (meth)acrylate or 3-hydroxypropyl (meth)acrylate, or ester of alkoxylated fatty alcohols, or sulfo-containing comonomers, for example 2-acrylamido-2-methylpropanesulfonic acid (AMPS) and the alkali metal salts thereof.

Preferably, graft copolymer (B), apart from monomer (c) and monocarboxylic acid (b) or dicarboxylic acid (b), does not comprise any further comonomers (d) in one or more side chains.

In one embodiment of the present invention, the proportion of graft base (a) in graft copolymer (B) is in the range from 40% to 95% by weight, preferably from 50% to 90% by weight, based in each case on overall graft copolymer (B).

In one embodiment of the present invention, the proportion of monocarboxylic acid (b) or dicarboxylic acid (b) is in the range from 2% to 40% by weight, preferably from 5% to 30% by weight and especially from 5% to 25% by weight, based in each case on overall graft copolymer (B).

Monomer or monomers (c) is/are copolymerized in amounts of 5% to 50% by weight, preferably of 5% to 40% by weight and more preferably of 5% to 30% by weight, based in each case on overall graft copolymer (B).

It is preferable when graft copolymer (B) comprises more copolymerized monocarboxylic acid (b) than monomer (c), and based on the molar proportions, for example, in the range from 1.1:1 to 5:1, preferably 2:1 to 4:1.

In one embodiment of the present invention, the mean molecular weight ($M_w$) of graft copolymer (B) is in the range from 1500 to 200 000 g/mol, preferably from 2000 to 150 000 and especially in the range from 3000 to 100 000 g/mol. The mean molecular weight $M_w$ is preferably measured by gel permeation chromatography in aqueous KCl/formic acid solution.

Graft copolymer (B) can preferably be obtained as an aqueous solution from which it can be isolated, for example by spray drying, spray granulation or freeze-drying. Optionally, solution of graft copolymer (B) or dried graft copolymer (B) can be used for production of the formulations of the invention.

It is preferable to stabilize graft copolymer (B) with at least one biocide. Examples of suitable biocides are isothiazolinones, for example 1,2-benzisothiazolin-3-one ("BIT"), octylisothiazolinone ("OIT"), dichlorooctylisothiazolinone ("DCOIT"), 2-methyl-2H-isothiazolin-3-one ("MIT") and 5-chloro-2-methyl-2H-isothiazolin-3-one ("CIT"), phenoxyethanol, alkylparabens such as methylparaben, ethylparaben, propylparaben, benzoic acid and its salts, for example sodium benzoate, benzyl alcohol, alkali metal sorbates, for example sodium sorbate, and optionally substituted hydantoins, for example 1,3-bis(hydroxymethyl)-5,5-dimethylhydantoin (DMDM hydantoin). Further examples are 1,2-dibromo-2,4-dicyanobutane, iodo-2-propynyl butyl carbamate, iodine and iodophors.

In one embodiment of the present invention, the formulation of the invention is free of phosphates and polyphosphates, including hydrogenphosphates, for example free of trisodium phosphate, pentasodium tripolyphosphate and hexasodium metaphosphate. "Free of" in connection with phosphates and polyphosphates shall be understood in the context of the present invention to mean that the total content of phosphates and polyphosphates is in the range from 10 ppm to 0.2% by weight, determined by gravimetry.

In one embodiment of the present invention, the formulation of the invention is free of those heavy metal compounds that do not act as bleach catalysts, especially of compounds of iron. "Free of" in connection with heavy metal compounds shall be understood in the context of the present invention to mean that the total content of heavy metal compounds that do not act as bleach catalysts is in the range from 0 to 100 ppm, preferably 1 to 30 ppm, determined by the Leach method.

"Heavy metals" in the context of the present invention are considered to be all metals having a specific density of at least 6 g/cm$^3$, except for zinc and bismuth. Heavy metals are especially considered to be precious metals, and also iron, copper, lead, tin, nickel, cadmium and chromium.

In one embodiment of the present invention, formulation of the invention comprises a total of in the range from 20% to 99% by weight of compound (A), preferably 40% to 98% by weight, more preferably 50% to 95% by weight, and a total of in the range from 1% to 40% by weight of graft copolymer (B), preferably 3% to 30% by weight, more preferably 5% to 20% by weight, based in each case on solids content of the formulation in question.

For liquid and solid formulations, the weight ratio of compound (A) to graft copolymer (B) is preferably in the range from 1:2 to 20:1.

In one embodiment, liquid formulations of the invention comprise a total of in the range from 20% to 99.9% by weight of compound (A), preferably 40% to 98% by weight, more preferably 50% to 95% by weight, and a total of in the range from 0.01% to 40% by weight of graft copolymer (B), preferably 3% to 30% by weight, more preferably 5% to 20% by weight, based in each case on the aqueous formulation of the invention in question.

Formulations of the invention may be free of bleaches, for example free of inorganic peroxide compounds or chlorine bleaches such as sodium hypochlorite. "Free of inorganic peroxide compounds or chlorine bleaches" shall be understood to mean that such formulations of the invention comprise a total of 0.01% by weight or less of inorganic peroxide compound and chlorine bleach, based in each case on solids content of the formulation of the invention in question.

In another embodiment of the present invention, formulation of the invention comprises (D) at least one inorganic peroxide compound, also referred to in the context of the present invention as peroxide (D) for short. Peroxide (D) is selected from hydrogen peroxide, sodium peroxodisulfate, sodium perborate and sodium percarbonate, preferably sodium percarbonate. In solid formulations of the invention preference is given to sodium percarbonate and in liquid formulations of the invention preference is given to hydrogen peroxide.

Solid peroxide (D) may be anhydrous or preferably aqueous. An example of aqueous sodium perborate is $Na_2[B(OH)_2(O_2)]_2$, sometimes also written as $NaBO_2.O_2.3H_2O$. An example of aqueous sodium percarbonate is $2\,Na_2CO_3.3\,H_2O_2$. More preferably, solid peroxide (D) is selected from aqueous percarbonates.

Percarbonates and especially sodium percarbonate are preferably used in coated form. The coating may be inorganic or organic in nature. Examples of coating materials are glycerol, sodium sulfate, silica gel, sodium silicate, sodium carbonate and combinations of at least two of the above coating materials, for example sodium carbonate and sodium sulfate.

Preferably, solid formulations of the invention comprise in the range from 1% to 30% by weight of peroxide (D), preferably 2% to 15% by weight, more preferably 3% to 12% by weight, based on solids content of the solid formulation in question.

Preferably, liquid formulations of the invention comprise in the range from 1% to 30% by weight of peroxide (D), preferably 2% to 15% by weight, more preferably 3% to 12% by weight, based in each case on the solids content of the formulation in question. In the case of the liquid formulation of the invention, peroxide (D) is preferably hydrogen peroxide.

Formulations of the invention which comprise at least one peroxide (D) are preferably liquid at room temperature.

In another embodiment, formulation of the invention comprises (D) at least one chlorine-containing bleach, which is also referred to in the context of the present invention as chlorine bleach (D) for short. Chlorine bleach (D) is preferably sodium hypochlorite.

Formulations of the invention that contain chlorine bleach (D) are preferably liquid at room temperature.

Preferably, formulation of the invention comprises in the range from 0.1% to 30% by weight of chlorine bleach (D), preferably 0.5% to 15% by weight, more preferably 1% to 12% by weight, based on solids content of the liquid formulation in question.

Formulations of the invention may comprise one or more further ingredients (E). Ingredients (E) are different than compound (A), graft copolymer (B) and peroxide (D) or chlorine bleach (D).

Formulations of the invention may include one or more further ingredients (E), for example one or more anionic or zwitterionic surfactants, one or more enzymes, one or more enzyme stabilizers, one or more alkali carriers, one or more acids, one or more bleach catalysts, one or more bleach activators, one or more bleach stabilizers, one or more defoamers, one or more corrosion inhibitors, one or more builder materials, buffers, dyes, one or more fragrances, one or more thickeners, one or more organic solvents, one or more tableting aids, one or more disintegrants, also called tablet disintegrants, or one or more solubilizers.

Examples of nonionic surfactants are $C_8$-$C_{20}$-alkylsulfates, $C_8$-$C_{20}$-alkylsulfonates and $C_8$-$C_2O$-alkyl ether sulfates having one to 6 ethylene oxide units per molecule, for example those of the following formula:

$$R^{12}—O(CH_2CH_2O)_u—SO_3M$$

$R^{12}$ is $C_8$-$C_{20}$-alkyl, branched or preferably unbranched. The variable u is in the range from 1 to 6.

In the context of the present invention, amphoteric surfactants refer to those substances that have a positive charge and a negative charge under use conditions. Examples of preferred amphoteric surfactants, which can also be referred to as zwitterionic surfactants, are what are called amine oxide surfactants and betaines or else betaine surfactants. Many betaines have one quaternized nitrogen atom and one carboxylic acid group per molecule. A particularly preferred example is cocoamidopropyl betaine.

Examples of amine oxide surfactants are compounds of the general formula (VII)

$$R^{13}R^{14}R^{15}N—O \qquad \text{(VII)}$$

where $R^{13}$, $R^{14}$ and $R^{15}$ are independently selected from aliphatic or cycloaliphatic or $C_2$-$C_4$-alkylene or $C_{10}$-$C_{20}$-alkylamido groups. More preferably, $R^{13}$ is selected from $C_8$-$C_{20}$-alkyl or $C_2$-$C_4$-alkylene $C_{10}$-$C_{20}$-alkylamido and $R^{14}$ and $R^{15}$ are each methyl. Particularly preferred examples are lauryldimethylamine oxide and cocoamidopropylamine oxide.

In one embodiment of the present invention, formulation of the invention may comprise in the range from 3% to 50% by weight of anionic or zwitterionic surfactant.

Formulations of the invention may comprise one or more enzymes. Examples of enzymes are lipases, hydrolases, amylases, proteases, cellulases, esterases, pectinases, lactases and peroxidases.

Formulations of the invention may comprise, for example, up to 5% by weight of enzyme, preferably 0.1% to 3% by weight, based in each case on total solids content of the formulation of the invention.

Formulations of the invention may comprise one or more enzyme stabilizers. Enzyme stabilizers serve for protection of enzyme—particularly during storage—against damage, for example inactivation, denaturing or breakdown, for instance as a result of physical influences, oxidation or proteolytic cleavage.

Examples of enzyme stabilizers are reversible protease inhibitors, for example benzamidine hydrochloride, borax, boric acids, boronic acids or the salts or esters thereof, including in particular derivatives with aromatic groups, for instance ortho-, meta- or para-substituted phenylboronic acids, especially 4-formylphenylboronic acid, or the salts or esters of the aforementioned compounds. Also used for this purpose are peptide aldehydes, i.e. oligopeptides with a reduced C terminus, especially those composed of 2 to 50 monomers. The peptidic reversible protease inhibitors include ovomucoid and leupeptin. Also suitable for this purpose are specific reversible peptide inhibitors for the protease subtilisin, and fusion proteins composed of proteases and specific peptide inhibitors.

Further examples of enzyme stabilizers are amino alcohols such as mono-, di-, triethanol- and -propanolamine and mixtures thereof, aliphatic mono- and dicarboxylic acids up to $C_{12}$-carboxylic acids, for example succinic acid. End group-capped fatty acid amide alkoxylates are also suitable enzyme stabilizers.

Other examples of enzyme stabilizers are sodium sulfite, reducing sugars and potassium sulfate. Another example of a suitable enzyme stabilizer is sorbitol.

Formulations of the invention may comprise one or more builders (E), especially phosphate-free builders (E). In the context of the present invention, compound (A) does not count as a builder (E). Examples of suitable builders (E) are silicates, especially sodium disilicate and sodium metasilicate, zeolites, sheet silicates, especially those of the formula $\alpha$-$Na_2Si_2O_5$, $\beta$-$Na_2Si_2O_5$, and $\delta$-$Na_2Si_2O_5$, and also ethylenediaminedisuccinic acid and polymeric builders (E), for example polycarboxylates and polyaspartic acid.

Most preferably, formulations of the invention comprise one or polymeric builders (E). Polymeric builders (E) are understood to mean organic polymers, especially polycarboxylates and polyaspartic acid. Polymeric builders (E) have only a negligible effect, if any, as a surfactant.

In one embodiment of the present invention, polymeric builder (E) is selected from polycarboxylates, for example alkali metal salts of (meth)acrylic acid homopolymers or (meth)acrylic acid copolymers.

Suitable comonomers are monoethylenically unsaturated dicarboxylic acids such as maleic acid, fumaric acid, maleic anhydride, itaconic acid and citraconic acid. A suitable polymer is especially polyacrylic acid, which preferably has a mean molecular weight $M_w$ in the range from 2000 to 40 000 g/mol, preferably 2000 to 10 000 g/mol, especially 3000 to 8000 g/mol. Also suitable are copolymeric polycarboxylates, especially those of acrylic acid with methacrylic acid and of acrylic acid or methacrylic acid with maleic acid and/or fumaric acid.

In one embodiment of the present invention, polymeric builder (E) is selected from one or more copolymers prepared from at least one monomer from the group consisting of monoethylenically unsaturated $C_3$-$C_{10}$-mono- or dicarboxylic acids or the anhydrides thereof, such as maleic acid, maleic anhydride, acrylic acid, methacrylic acid, fumaric acid, itaconic acid and citraconic acid, and at least one hydrophilic or hydrophobic comonomer, as enumerated below.

Suitable hydrophobic monomers are, for example, isobutene, diisobutene, butene, pentene, hexene and styrene, olefins having 10 or more carbon atoms or mixtures thereof, for example 1-decene, 1-dodecene, 1-tetradecene, 1-hexadecene, 1-octadecene, 1-eicosene, 1-docosene, 1-tetracosene and 1-hexacosene, $C_{22}$-$\alpha$-olefin, a mixture of $C_{20}$-$C_{24}$-$\alpha$-olefins and polyisobutene having an average of 12 to 100 carbon atoms.

Suitable hydrophilic monomers are monomers having sulfonate or phosphonate groups and nonionic monomers having a hydroxyl function or alkylene oxide groups. Examples include: allyl alcohol, isoprenol, methoxy polyethylene glycol (meth)acrylate, methoxy polypropylene glycol (meth)acrylate, methoxy polybutylene glycol (meth) acrylate, methoxy poly(propylene oxide-co-ethylene oxide) (meth)acrylate, ethoxy polyethylene glycol (meth)acrylate, ethoxy polypropylene glycol (meth)acrylate, ethoxy polybutylene glycol (meth)acrylate and ethoxy poly(propylene oxide-co-ethylene oxide) (meth)acrylate. The polyalkylene glycols comprise 3 to 50, especially 5 to 40 and particularly 10 to 30 alkylene oxide units.

Particularly preferred sulfo-containing monomers here are 1-acrylamido-1-propanesulfonic acid, 2-acrylamido-2-propanesulfonic acid, 2-acrylamido-2-methylpropanesulfonic acid, 2-methacrylamido-2-methylpropanesulfonic acid, 3-methacrylamido-2-hydroxypropanesulfonic acid, allylsulfonic acid, methallylsulfonic acid, allyloxybenzenesulfonic acid, methallyloxybenzenesulfonic acid, 2-hydroxy-3-(2-propenyloxy)propanesulfonic acid, 2-methyl-2-propene-1-sulfonic acid, styrenesulfonic acid, vinylsulfonic acid, 3-sulfopropyl acrylate, 2-sulfoethyl methacrylate, 3-sulfopropyl methacrylate, sulfomethacrylamide, sulfomethylmethacrylamide and salts of the aforementioned acids, for example the sodium, potassium or ammonium salts thereof.

Particularly preferred monomers containing phosphonate groups are vinylphosphonic acid and salts thereof.

In addition, one or more amphoteric polymers other than graft polymer (B) may be used as polymeric builders (E). Examples of amphoteric polymers are copolymers of at least one ethylenically unsaturated carboxylic acid, selected from acrylic acid and methacrylic acid, at least one amide, selected from N—$C_1$-$C_{10}$-alkyl(meth)acrylamide, acrylamide and methacrylamide, and at least one comonomer selected from DADMAC, MAPTAC and APTAC.

Formulations of the invention may comprise, for example, in the range from a total of 1% to 75% by weight, preferably to 50% by weight, of builder (E), based on the solids content of the formulation of the invention in question.

Formulations of the invention may comprise, for example, in the range from a total of 1% to 15% by weight, preferably to 10% by weight, of polymeric builder (E), based on the solids content of the formulation of the invention in question.

In a particularly preferred embodiment, formulation of the invention comprises, as well as graft polymer (B), a polymeric builder (E). The weight ratio of polymeric builder (E) to graft copolymer (B) in that case is preferably 30:1 to 1:3, more preferably 20:1 to 1:1.

In one embodiment of the present invention, formulations of the invention may comprise one or more cobuilders.

Examples of cobuilders are phosphonates, for example hydroxyalkanephosphonates and aminoalkanephosphonates. Among the hydroxyalkanephosphonates, 1-hydroxyethane-1,1-diphosphonate (HEDP) is of particular significance as a cobuilder. It is preferably used in the form of the sodium salt, the disodium salt giving a neutral reaction and the tetrasodium salt an alkaline reaction (pH 9). Useful aminoalkanephosphonates are preferably ethylenediaminetetramethylenephosphonate (EDTMP), diethylenetriaminepentamethylenephosphonate (DTPMP) and the higher homologs thereof. They are preferably used in the form of the sodium salts that give a neutral reaction, for example of the hexasodium salt of EDTMP or of the hepta- and octasodium salt of DTPMP.

Formulations of the invention may comprise one or more alkali carriers. Alkali carriers ensure, for example, the pH of at least 9 when an alkaline pH is desired. Suitable examples are alkali metal carbonates, alkali metal hydrogencarbonates, alkali metal hydroxides and alkali metal metasilicates. A preferred alkali metal in each case is potassium, more preferably sodium. In place of or in addition to alkali carriers, it is also possible to use organic amines, alkanolamines, for example triethanolamine, or ammonia.

Formulations of the invention may comprise one or more bleach catalysts. Bleach catalysts can be selected from bleach-boosting transition metal salts or transition metal complexes, for example manganese-, iron-, cobalt-, ruthenium- or molybdenum-salen complexes, or manganese-, iron-, cobalt-, ruthenium- or molybdenum-carbonyl complexes. Also usable as bleach catalysts are manganese, iron, cobalt, ruthenium, molybdenum, titanium, vanadium and copper complexes with nitrogen-containing tripod ligands, and cobalt-, iron-, copper- and ruthenium-ammine complexes.

Formulations of the invention may comprise one or more bleach activators, for example N-methylmorpholinioacetonitrile salts ("MMA salts"), trimethylammonioacetonitrile salts, N-acylimides, for example N-nonanoylsuccinimide, 1,5-diacetyl-2,2-dioxohexahydro-1,3,5-triazine ("DADHT") or nitrile quats (trimethylammonioacetonitrile salts).

Further examples of suitable bleach activators are tetraacetylethylenediamine (TAED) and tetraacetylhexylenediamine.

Formulations of the invention may comprise one or more corrosion inhibitors. This is understood in the present case to mean those compounds that inhibit the corrosion of metal. Examples of suitable corrosion inhibitors are triazoles, especially benzotriazoles, bisbenzotriazoles, aminotriazoles, alkylaminotriazoles, and also phenol derivatives, for example hydroquinone, catechol, hydroxyhydroquinone, gallic acid, phloroglucinol or pyrogallol, and also polyethyleneimine and salts of bismuth or zinc.

In one embodiment of the present invention, formulations of the invention comprise a total of in the range from 0.1% to 1.5% by weight of corrosion inhibitor, based on the solids content of the formulation of the invention in question.

Formulations of the invention may comprise one or more builder materials, for example sodium sulfate.

Formulations of the invention may comprise one or more defoamers, selected, for example, from silicone oils and paraffin oils.

In one embodiment of the present invention, formulations of the invention comprise a total of in the range from 0.05% to 0.5% by weight of defoamer, based on the solids content of the formulation of the invention in question.

In one embodiment of the present invention, formulations of the invention may comprise one or more acids. Suitable acids are organic acids and inorganic acids. Organic acids selected may, for example, be methanesulfonic acid, formic acid, acetic acid, glycolic acid, lactic acid, succinic acid and/or adipic acid. As inorganic acid, preference is given to using hydrochloric acid or phosphoric acid or amidosulfonic acid. It is also possible to use mixtures of acids, including mixtures of organic and inorganic acids. The use of acids in formulations of the invention is an option especially when the corresponding cleaner, in addition to the advantages of the invention, is also to have improved removal of limescale, rust or urine scale, for example in shower cleaners, bathroom cleaners or toilet cleaners.

In one embodiment, solid formulations of the invention comprise one or more disintegrants, also called tablet disintegrants. Examples are starch, polysaccharides, for example dextrans, and also crosslinked polyvinylpyrrolidone and polyethylene glycol sorbitan fatty acid esters.

In one embodiment of the present invention, those formulations of the invention that are liquid at room temperature comprise one or more thickeners.

In order to achieve the desired viscosity of the formulation of the invention in question, preferably one or more thickeners are added to formulations of the invention in gel form, and it is found to be particularly advantageous when the formulation of the invention in question comprises thickeners in the range from 0.5% to 30% by weight, preferably from 1% to 20% by weight and more preferably from 2% to 15% by weight, based on the solids content of the formulation of the invention in question.

Thickeners selected may be naturally occurring polymers or modified natural products or synthetic thickeners.

Examples of naturally occurring polymers suitable as thickeners in the context of the present invention include: agar agar, carrageenan, tragacanth, gum arabic, alginates, pectins, polyoses, guar flour, carob seed flour, starch, dextrins, xanthan, gelatin and casein.

Examples of thickeners from the group of the modified natural products can be selected, for example, from the group of the modified starches and celluloses. Examples include carboxymethyl cellulose and other cellulose ethers, hydroxyethyl cellulose and hydroxypropyl cellulose, and seed flour ethers.

Synthetic thickeners are selected from partly crosslinked poly(meth)acrylic acids, hydrophobically modified polyurethanes (HEUR thickeners), and poly(meth)acrylic acid copolymers esterified with fatty alcohol ethoxylates (HASE thickeners).

A thickener used with particular preference is xanthan.

In one embodiment of the present invention, formulations of the invention may comprise one or more synthetic or natural waxes; particular preference is given to carnauba wax. Wax is especially added for finishing of sensitive surfaces, for example in floor cleaners.

In one embodiment of the present invention, formulations of the invention may comprise one or more organic solvents. For example, organic solvents can be selected from the groups of the monoalcohols, diols, triols or polyols, or the esters, ethers and amides. Particular preference is given to organic solvents that are water-soluble, "water-soluble" solvents in the context of the present application being solvents that are fully miscible with water, i.e. without a miscibility gap, at room temperature.

Organic solvents that are suitable for formulations of the invention are preferably selected from the group of mono- or polyhydric alcohols, alkanolamines or glycol ethers that are miscible with water within the concentration range specified. Preferably, organic solvents are selected from ethanol, n-propanol, isopropanol, butanols, glycol, propane-1,2-diol, or butanediol, glycerol, diglycol, propyl- or n-butyldiglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl, ethyl or propyl ether, dipropylene glycol methyl or ethyl ether, methoxy-, ethoxy- or butoxytriglycol, 1-butoxyethoxy-2-propanol, 3-methyl-3-methoxybutanol, propylene glycol t-butyl ether and mixtures of two or more of the aforementioned organic solvents.

In a specific embodiment of the present invention, formulations of the invention have a pH in the range from 1 to 6, preferably 1 to 4. In the case of those formulations of the invention that are solid at room temperature, the pH of a 1% by weight aqueous solution or of the liquid phase of a 1% by weight aqueous suspension is determined.

In a further specific embodiment of the present invention, formulations of the invention have a pH in the range from 6 to 14, preferably 7 to 10. In the case of those formulations of the invention that are solid at room temperature, the pH of a 1% by weight aqueous solution or of the liquid phase of a 1% by weight aqueous suspension is determined.

Formulations of the invention are of very good suitability as or for production of rinse aids for dishwashing, especially for machine dishwashing ("automatic dishwashing" or ADW for short). Formulations of the invention themselves, and dishwashing compositions produced from formulations of the invention—especially phosphate-free dishwashing compositions produced from formulations of the invention—have very good inhibition of scale, especially on glassware, in machine dishwashing. More particularly, formulations of the invention are also effective against persistent stains.

Examples of metalware are cutlery, pots, pans and garlic presses, especially items of cutlery such as knives, cake slices and serving implements.

Examples of glassware include: glasses, glass bowls, glass dishware, for example glass plates, but also articles which have at least one glass surface and may have been decorated or be undecorated, for example glass vases, transparent pan lids and glass vessels for cooking.

Examples of plasticware include plates, cups, beakers and bowls made from melamine, polystyrene and polyethylene.

Examples of porcelainware include plates, cups, beakers and bowls made from porcelain, white or colored, each with or without decoration.

Formulations of the invention are suitable not only as or for production of dishwasher detergents, but also as or for production of cleaning compositions for hard surfaces, for example floor cleaners, all-purpose kitchen cleaners or all-purpose bathroom cleaners.

In embodiments in which formulations of the invention are used as all-purpose bathroom cleaners, for example, an acidic pH is preferred, for example in the range from 1 to 6.5. In embodiments in which formulations of the invention are used as all-purpose kitchen cleaners, a neutral or alkaline pH is preferred, for example in the range from 7 to 10.

In order to achieve an acidic pH, it is possible to use di- or polycarboxylic acids, for example acetic acid or tartaric acid.

Floor cleaners and all-purpose cleaners are intended for use for cleaning of sensitive surfaces and generally have a pH in the range from about 5 to 8. In many variants, care materials such as waxes are also added to floor cleaners and all-purpose cleaners for care of the surfaces. The same applies to manual dishwashing detergents and paint cleaners, for example for automobiles.

Kitchen cleaners preferably have a pH of 8 to 14 and achieve optimal detachment or removal of fat by virtue of the strongly alkaline pH.

Bath, shower and toilet cleaners preferably have an acidic pH, for example of 1 to 5, and by virtue of the strongly acidic pH achieve optimal detachment of limescale or urine scale. If addition of bleach to the bath, shower or toilet cleaner is intended, preference is given to combinations of hypochlorite-based chlorine bleach with base. Another preferred combination is that of peroxide bleaches such as hydrogen peroxide with acids. Combinations of this kind have better storage stability.

In the context of the present invention, hard surfaces are surfaces of materials that are not water-soluble and preferably not swellable either under cleaning conditions. They preferably have a Mohs hardness of 3 or more. Examples include: slabs, glass, glass fibers, tiles, ceramic, porcelain, enamel, concrete, stone materials, leather, metals and alloys such as iron, aluminum and steel, hardwood, painted surfaces and coatings, polymers and plastics, for example polyethylene, polypropylene, PMMA, polycarbonates, polyesters, for example PET, polystyrene and rigid PVC, fiber-reinforced plastics, for example laminate, and also silicon surfaces, for example of wafers, and composite materials. Hard surfaces may have a smooth appearance to the human eye or else have structuring, for example elevations or depressions, for example grooves, and they may be convex or concave.

Slabs and tiles may form part, for example, of bathrooms, kitchens, hospitals, or else form part of machines.

In one embodiment of the present invention, cleaning is accomplished using water having a hardness in the range from zero to 30° dH, preferably 2 to 25° dH, German hardness (dH) being understood to mean more particularly the sum of magnesium hardness and calcium hardness.

The present invention further provides a process for producing formulations of the invention, also called production process of the invention in the context of the present invention. The production process of the invention comprises mixing at least one compound (A), at least one graft copolymer (B) and optionally one or more further ingredients (E) and optionally peroxide (D) or chlorine bleach (D) with one another in one or more steps, optionally in the presence of water, and then optionally wholly or partially removing water.

Compound (A), graft copolymer (B), peroxide (D) and further ingredients (E) have been described above.

In another embodiment of the present invention, compound (A), one or more further ingredients (E) and optionally peroxide (D) are mixed in dry form and then an aqueous solution of graft copolymer (B) is added, either outside or within a machine dishwasher.

In another embodiment of the present invention, compound (A), graft copolymer (B) and one or more further ingredients (E) and optionally peroxide (D) or chlorine bleach (D) are mixed in dry form and the mixture thus obtained is compressed to shaped bodies, especially to tablets.

In one embodiment of the present invention, the at least partial removal of the water may be preceded by mixing with one or more further ingredients (E) for formulation of the invention, for example with one or more surfactants, one or more enzymes, one or more enzyme stabilizers, one or more builders (E), preferably one or more phosphate-free builders (E), especially one or more polymeric builders (E), one or more cobuilders, one or more alkali carriers, one or more bleach catalysts, one or more bleach activators, one or more bleach stabilizers, one or more defoamers, one or more corrosion inhibitors, one or more builder materials, with buffer or dye.

In one embodiment, the procedure is to remove the water wholly or partly from formulation of the invention, for example down to a residual moisture content in the range from zero to 15% by weight, preferably 0.1% to 10% by weight, by evaporating it, for example by spray drying, spray granulation or compaction.

In one embodiment of the present invention, the water is removed wholly or partly at a pressure in the range from 0.3 to 2 bar.

In one embodiment of the present invention, the water is removed wholly or partly at temperatures in the range from 60 to 220° C.

In another embodiment, the water is not removed. Instead, further water can be added. More preferably, a thickener is also added. In this way, liquid formulations of the invention can be obtained. At room temperature, liquid formulations of the invention may, for example, be in gel form, as emulsion or as solution.

Through the production process of the invention, it is easily possible to obtain formulations of the invention.

The formulations of the invention may be in liquid or solid form, in mono- or polyphasic form, as tablets or in the form of other dosage units, for example of pouches, in packaged or unpackaged form.

The invention is elucidated by working examples.

Graft copolymer (B.1) corresponds to graft copolymers (B.4) from WO 2015/197379. It was prepared as follows:

Comonomers used:

(a.1): maltodextrin, commercially available as Cargill C*Dry MD01955

(b.1): acrylic acid (c.1): [2-(methacryloyloxy)ethyl]trimethylammonium chloride ("TMAEMC")

Preparation of Graft Copolymer (B.1)

A stirred reactor was initially charged with 220 g of (a. 1) in 618 g of water and heated to 80° C. while stirring. At 80° C. the following solutions were metered in simultaneously and via separate feeds as follows:

a) an aqueous solution of 40.6 g of (c.1) in 149 g of water, within 4 hours.

b) a solution of 9.85 g of sodium peroxodisulfate in 68.0 g of water within 5 h, beginning simultaneously with the metered addition of a).

c) a solution of 32.8 g (b.1) and 36.5 g of sodium hydroxide solution (50% in water), diluted with 139 g of water, within 2 hours, beginning 2 hours after commencement of metered addition of a).

On completion of addition of solutions a) to c), the reaction mixture was stirred at 80° C. for one hour. Subsequently, a solution of 0.73 g of sodium peroxodisulfate in 10.0 g of water was added and the mixture was stirred at 80° C. for a further 2 hours. Subsequently, the mixture was cooled to room temperature and 8 g of biocide were added. A 22.4% by weight solution of graft copolymer (B.1) was obtained.

The biocide used was a 9% by weight solution of 1,2-benzisothiazolin-3-one in water-propylene glycol mixture, commercially available as Proxel™ XL2 Antimicrobial. Stated amounts in g are tel quel.

Inventive formulations KSF.3 and comparative formulations V-KSF.1 and V-KSF.2 were produced. The components of comparative formulations V-KSF.1 and V-KSF.2 and of inventive formulation KSF.3 are apparent from table 1. The production proceeded from an initial charge of water. While stirring, isopropanol, anionic surfactant and nonionic surfactant and finally the copolymer (B.1) were added.

TABLE 1

Composition of comparative formulations V-KSF.1 and V-KSF.2 and of inventive formulation KSF.3

| | | V-KSF.1 | | V-KSF.2 | | KSF.3 | |
|---|---|---|---|---|---|---|---|
| Feedstock | Conc. | Concentration | [g] | Concentration | [g] | Concentration | [g] |
| Nonionic surfactant 1 | 95% | 5% | 2.6 | 5% | 2.6 | 5% | 2.6 |
| Anionic surfactant 1 | 40% | 10% | 12.5 | 10% | 12.5 | 10% | 12.5 |
| Isopropanol | 100% | 5% | 2.5 | 5% | 2.5 | 5% | 2.5 |
| V-P.1 | 22% | — | — | 1% | 2.3 | — | — |
| (B.1) | 22.4% | — | — | — | — | 1% | 2.3 |
| Demineralized water | | 80% | 32.4 | 79% | 30.1 | 79% | 30.1 |
| Batch size [g] | | 50 | | 50 | | 50 | |
| Appearance | | clear, colorless | | clear, pale yellowish | | clear, colorless | |

Concentrations are always reported in % by weight.

Nonionic surfactant 1: n-$C_{16}H_{33}$—O—$(C_2H_4O)_{25}$—OH

Anionic surfactant 1: sodium cumenesulfonate

The comparative polymer V-P.1 was prepared according to example 4 from EP 2 138 560 B1.

EXAMPLES

I. Production of Inventive Rinse Formulations and of Comparative Formulations

In the context of the present application, figures in % are percent by weight, unless explicitly stated otherwise.

Tests for Inhibition of Scale

All washing tests were conducted in a Miele G1222 SCL machine dishwasher. The program with 65° C. for the wash cycle and 65° C. for the rinse cycle was selected. The tests were conducted with hardened water having a water hardness of 21° dH (Ca/Mg):$HCO_3$ (3:1):1.35. The installed water softener (ion exchanger) was not regenerated with regenerating salt. For each washing test, 18 g of the formulation (see table: Composition of the formulation for scale inhibition tests) were metered in. Simultaneously with the formulation, 50 g of a ballast soil were added, consisting of grease, protein and starch.

In the "clear-rinse" program step, 3 mL in each case of the rinse aid formulation specified in each case (V-KS 1, V-KS 2 or KS3) were metered in.

The test ware used in each cleaning cycle was three stainless steel knives and three drinking glasses. Between every two rinse cycles, there was a delay of one hour, with the machine dishwasher door closed for 10 min thereof and opened for 50 min thereof.

After the 30th rinse cycle had ended, the dishware was removed from the machine after drying.

The test ware was inspected visually in a darkened chamber under light behind an aperture and assessed with regard to streaks and film-like deposits according to a grade scale from 1 (=severe residues) to 10 (=no residues).

TABLE 2

Composition of the formulation for scale inhibition tests

| Constituent [g] | |
|---|---|
| Racemic MGDA-$Na_3$, 78% by weight, remainder: water | 10 |
| Citric acid as trisodium salt monohydrate | 35 |
| Polyacrylic acid $M_w$ 4000 g/mol as sodium salt, fully neutralized | 5 |
| Sodium percarbonate, 2 $Na_2CO_3$•3 $H_2O_2$ | 10.2 |
| Nonionic surfactant 1 | 4 |
| Nonionic surfactant 2 | 1 |
| Protease | 2.5 |
| Amylase | 1 |
| $Na_2Si_2O_5$, commercially available as Britesil ® H 265 LC | 2 |
| TAED | 4 |
| $Na_2CO_3$ | 24.5 |
| 1-Hydroxyethane-1,1-diphosphonate disodium salt | 0.8 |

Nonionic surfactant 1: n-$C_8H_{17}$—CH(OH)—$CH_2$—O-$(EO)_{22}$-CH($CH_3$)—$CH_2$—O—n-$C_{10}H_{21}$
Nonionic surfactant 2: n-$C_{10}H_{21}$—CH(OH)—$CH_2$—O-$(EO)_{40}$-n-$C_{10}H_{21}$

TABLE 3

Result of the scale inhibition tests with rinse aid

| Formulation | Rinse aid in clear-rinse cycle | Filming of knives | Filming of glass |
|---|---|---|---|
| 18 g | 3 mL V-KSF.1 | 4.3 | 4.0 |
| 18 g | 3 mL V-KSF.2 | 5.5 | 4.0 |
| 18 g | 3 mL KSF.3 | 5.7 | 5.7 |

II. Production of Inventive Cleaning Formulations

Liquid inventive cleaning formulation RF.1 and liquid comparative formulations V-RF.2 and V-RF.3 were produced by producing/using and mixing the components according to table 4 each in the form of aqueous solutions.

TABLE 4

Composition

| | Formulation | | |
|---|---|---|---|
| Component | RF.1 | V-RF.2 | V-RF.3 |
| (VI.1) | 0.75 | 0.75 | 0.75 |
| Nonionic surfactant 4 | 0.25 | 0.25 | 0.25 |
| (B.1) | 0.1 | 0 | 0 |

TABLE 4-continued

Composition

| | Formulation | | |
|---|---|---|---|
| Component | RF.1 | V-RF.2 | V-RF.3 |
| V-P.1 | 0 | 0.1 | 0 |
| Water | | to 100 | |
| pH | 7.3 | 7.1 | 9.1 |

(VI.1): alkyl polyglycoside mixture with $G^1$ = glucose, y = 1.4, $R^{10}$ = hydrogen, and $R^{11}$ = n-$C_8$-alkyl/n-$C_{10}$-alkyl
Nonionic surfactant 4: 2-n-propylheptanol, ethoxylated with 6 equivalents of ethylene oxide In order to determine the primary cleaning performance, the IPP form was used, as published in SÖFW, NO10/1986, page 371. For the test, a synthetic IPP soil (83/21) of the following composition was used:

40% Nytex 801 (mineral oil), 36% 80/110 gasoline, 70% Myritol 318 (triglyceride) and 7% Special Black 4. For this purpose, the mineral oil, Myritol and gasoline were mixed and the Special Black was mixed in gradually. The mixture thus obtained was homogenized with an Ultraturrax device at speed 4-5 for 30 minutes and aged in a closed Erlenmeyer flask on a stirrer plate for 21 days. This was followed by homogenization again for 30 minutes.

0.16 mL of this soil in each case was applied with a brush to 5 PVC test strips having an area of 3, 5·42 cm. The soiled test strips were dried for 90 minutes. For the cleaning, sponges that had been washed in a washing machine at 30° C. and then dried in a drier were prepared. Prior to use, the sponges were moistened with deionized water and dried by squeezing the water out once. The soiled test strips were secured in a Gardner abrasion tester. After application of 20 mL each time of inventive cleaner formulation or comparative cleaner solution to the prepared sponges, these cleaned the soiled test strips in 10 abrasion cycles with a pressure of 300 g. The cleaned test strips were then rinsed under running water and dried at room temperature.

After 24 hours, the reflection of the cleaned strips was measured. The results are compiled in table 5.

TABLE 5

Results of the cleaning experiments

| Formulation | Removal of soil in % |
|---|---|
| F.1 | 70.6 |
| V-F.2 | 67.1 |
| V-F.3 | 63.5 |

The invention claimed is:

1. A formulation comprising (A) at least one nonionic surfactant, (B) at least one graft copolymer formed from (a) at least one graft base selected from nonionic monosaccharides, disaccharides, oligosaccharides and polysaccharides, and side chains, obtainable by grafting of (b) at least one ethylenically unsaturated mono- or dicarboxylic acid and (c) at least one compound of a general formula (I)

(I)

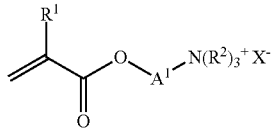

wherein the variables are defined as follows:

$R^1$ is selected from methyl and hydrogen, $A^1$ is selected from $C_2$-$C_4$-alkylene, $R^2$ are the same or different and are selected from $C_1$-$C_4$-alkyl, $X^-$ is selected from halide, mono-$C_1$-$C_4$-alkylsulfate and sulfate; and (C) a total of zero to 0.5% by weight of methylglycinediacetic acid (MGDA) and glutaminediacetic acid (GLDA) and alkali metal salts of MGDA and GLDA and a total of zero to 0.5% by weight of citric acid or an alkali metal salt of citric acid, wherein figures in % by weight are based in each case on a solids content of the formulation.

2. The formulation according to claim 1, wherein compound (c) is ω-trimethylaminoethyl(meth)acrylatochloride.

3. The formulation according to claim 1, wherein compound (A) is selected from alcohol alkoxylates and alkyl polyglycosides.

4. The formulation according to claim 1, wherein the formulation further comprises water.

5. The formulation according to claim 1, wherein the formulation further comprises at least one organic peroxide compound (D) or a chlorine bleach (D).

6. The formulation according to claim 1, wherein the formulation comprises at least one acid or base.

7. The formulation according to claim 1, wherein the formulation comprises:

a total of in a range from 20% to 99% by weight of compound (A), a total of in a range from 1% to 40% by weight of graft copolymer (B), based in each case on the solids content of the formulation.

8. The formulation according to claim 1, wherein a weight ratio of compound (A) to graft copolymer (B) is in a range from 1:2 to 20:1.

9. The formulation according to claim 1, wherein the formulation is liquid at room temperature.

10. The formulation according to claim 1, wherein the formulation is solid at room temperature.

11. A method of using the formulation according to claim 1, the method comprising using the formulation for cleaning or rinsing hard surfaces.

12. The method of use according to claim 11, wherein the cleaning or rinsing is of slabs, tiles, glass, stainless steel, wood, aluminum, enamel or ceramic.

13. The method of use according to claim 11, wherein the cleaning or rinsing is effected by hand or with an aid of a machine.

14. A process for producing the formulation according to claim 1, the process comprising mixing at least one nonionic surfactant (A) and at least one graft copolymer (B) and optionally one or more further ingredients (E) and optionally peroxide (D) or chlorine bleach (D) with one another in one or more steps, optionally in a presence of water, and then optionally wholly or partially removing water.

15. The formulation of claim 1, wherein methylglycinediacetic acid (MGDA) and glutaminediacetic acid (GLDA) and alkali metal salts of MGDA and GLDA is present in an amount from zero to 0.1 wt %.

* * * * *